US006203446B1

(12) United States Patent
Collins

(10) Patent No.: US 6,203,446 B1
(45) **Date of Patent: *Mar. 20, 2001**

(54) PUTTER GOLF CLUB WITH REARWARDLY POSITIONED SHAFT

(76) Inventor: Clark E. Collins, 896 Sandalwood Pl., Jenson Beach, FL (US) 34957

( * ) Notice: Subject to any disclaimer, the term of this patent is extended or adjusted under 35 U.S.C. 154(b) by 0 days.

This patent is subject to a terminal disclaimer.

(21) Appl. No.: 09/039,353

(22) Filed: Mar. 13, 1998

Related U.S. Application Data

(63) Continuation of application No. 08/738,036, filed on Oct. 24, 1996, and a continuation-in-part of application No. 08/692,453, filed on Aug. 5, 1996, which is a continuation-in-part of application No. 08/488,809, filed on Jun. 9, 1995, now Pat. No. 5,544,879.

(51) Int. Cl.[7] ..... A63B 53/04; A63B 53/12

(52) U.S. Cl. ..... 473/313; 473/314; 473/340; 473/294; 473/296

(58) Field of Search ..... 473/219, 251, 473/256, 305, 306, 307, 308, 309, 310, 311, 312, 313, 314, 315, 316, 324, 340, 341, 294, 293, 296

(56) References Cited

U.S. PATENT DOCUMENTS 5,544,879 * 8/1996 Collins .
5,785,608 * 7/1998 Collins .

* cited by examiner

*Primary Examiner*—Sebastiano Passaniti
(74) *Attorney, Agent, or Firm*—Frank A. Cona

(57) ABSTRACT

A golf putter is provided having a head and shaft. The shaft enters the head at a point at least about 70% of the length of the putter away from the front face. The shaft is angled about 10° to about 20° toward the front face of the head and angled about 10° to about 20° toward a user grasping the shaft.

20 Claims, 7 Drawing Sheets

PUTTER GOLF CLUB WITH REARWARDLY POSITIONED SHAFT

REFERENCE TO RELATED APPLICATIONS

This application is a continuation of copending application Ser. No. 08,738,036 filed on Oct. 24, 1996 and this application is a continuation-in-part application of copending application Ser. No. 08/692,453, filed Aug. 5, 1996 which, in turn, is a continuation-in-part application of application Ser. No. 08/488,809, filed Jun. 9, 1995, now U.S. Pat. 5,544,879, issued Aug. 13, 1996.

BACKGROUND OF THE INVENTION

1. Field of the Invention

This invention relates to a putter golf club (putter). More particularly, the present invention relates to a putter with a head having a shaft positioned at a rearward portion of the head relative to the front face of the putter.

2. Description of Prior Art

At the present time, there are available a wide variety of putters which are golf clubs designed for striking a golf ball on substantially smooth grass portions of a golf course known as "putting greens". Since putting accounts for approximately one half of the golf strokes which a normal golfer takes during a round of golf, it is particularly important that the putter be designed to permit an accurate putting stroke.

The most common putter design at the present time is some variation of a simple relatively light weight "blade" on the end of a relatively short shaft as exemplified by U.S. Pat. No. 4,429,875. A blade type putter is relatively low weight club which requires the user to strike the ball with a higher velocity in order to impart a desired momentum (mass times velocity) to the golf ball. When utilizing the required higher velocity, the user tends to lose control over the putting stroke. In addition, with a light weight club head, the inertia of the ball and club head are similar so that when the ball contacts the club head slightly off-line from the center of mass of the club head, the club head tends to rotate thereby causing the ball to move away from the club head at an angle that deviates from the intended direction together with a spinning motion on the ball that further adversely influences the ball's path. With a relatively low weight club head any small irregular motion on the part of the user produces a relatively large deviation in the club head velocity and direction which results in erratic puffing.

There are also available a wide variety of putters having a club head which includes weights or which have a head having a larger weight than a blade putter. Such structures are exemplified by those disclosed in U.S. Pat. Nos. 3,762,717; 4,195,842; 4,411,430; 4,756,535; 4,834,387 and 5,082,277. These putter structures represent attempts to enlarge the "sweet spot" on the club head face. The "sweet spot" is the area on the putter face which, when used to strike the golf ball imparts little or no vibration and little or no torque to the putter. It is desirable to enlarge the sweet spot so as to provide the user with a large margin of error when striking the ball.

Another common problem among golfers is the inability to initiate a putting motion i.e., freezing during preparation for a putt, known in golfing terminology as the "yips". This condition may result, in part from the sensitive nature of the putt and the appreciation that the slightest lack of control and the delicate putting motion will result in an unwanted result. Prior attempts to overcome this condition include the use of putters having a relatively long shaft such as are exemplied by those described in U.S. Pat. Nos. 4,163,554 and 5,209,474.

Accordingly, it would be desirable to provide a putter that allows the user to have a more consistent putting stroke which would thereby provide more accuracy in putting a golf ball. In addition, it would be desirable to provide a putter with a head having a large sweet spot. Furthermore, it would be desirable to provide a putter with a shaft positioned to minimize undesired club head movement when executing a putting stroke.

SUMMARY OF THE INVENTION

In accordance with this invention, a golf club putter is provided which comprises a head and a shaft wherein the head can include one or more optional weights and the shaft is positioned into a rearward position of the head. The head comprises a mallet-like club head having a flat front face and wherein all or a portion of the side edges and back edge of the putter are curved. The putter shaft is inserted directly into the head and enters the head at a compound angle wherein the shaft is angled sightly toward the front face of the head and is angled slightly toward the user of the putter. The shaft is positioned in a rearward position closer to the back edge than the front face of the head so that at least a majority of the weight of the head is positioned forward of the shaft toward the front face, enabling the user to have a more direct mass behind the ball at contact.

An elongated shaft can be utilized so that the end of the shaft distal from the head can be rendered essentially motionless by the application of force of the user's arm against the shaft and against the user's ribs. The putter face is angled as a single angle or as a compound angle by being angled at a bottom portion of the face toward the back edge at a first angle and at a top portion of the face toward the back edge at a second angle larger than the first angle. The putter embodiment of this invention having the compound angled face provides the user with a better view of the face and a ball in contact with the face as compared to a putter face having a single angle.

It has been found that the putter of this invention provides a larger sweet spot as compared to putters having a different shaft configuration and position. By positioning the shaft rearwardly of the majority of the weight of the head, the rearward portion of the putter including the shaft follows the forwardly positioned portion of the head weight. After motion of the putter has been initiated, the momentum of the moving forward portion of the head reduces the need for added force on the shaft by the user and thus reduces the opportunity for applying undesirable force direction to the shaft by the user. In addition, in one embodiment, the user of the putter of this invention is provided with an improved view of the position of a golf ball relative to the face for contacting the ball.

DESCRIPTION OF SPECIFIC EMBODIMENTS

Figure 1:
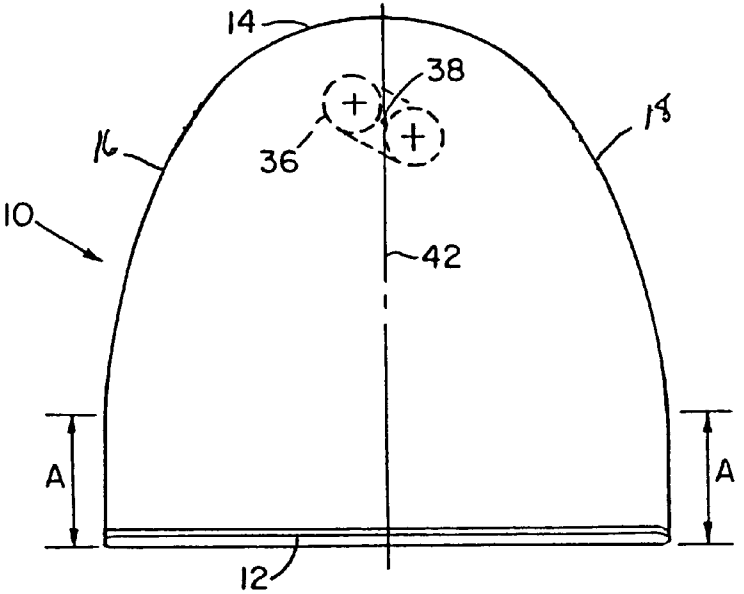
FIG. 1 is a top view of shaft position into a putter head of this invention.

The putter of this invention has a mallet-like head having a front face which is used to contact the golf ball, a back edge, side edges, a top surface through which a shaft extends and a bottom surface. The back edge and side edges can be linear or curved. The head can be formed from any metal such as aluminum, aluminum alloy, steel, or brass or a non-metallic material such as a polymeric composition, e.g., polycarbonate, preferably aluminum or low density aluminum alloy. If desired, additional weight can be added to the putter head. The optional weights can be added to a surface of the putter head or can be embedded within the volume of the putter head in any conventional manner.

The shaft is positioned at least about 70%, preferably at least about 85% of the maximum length of the putter head away from the front face toward the back edge. By positioning the weight of the putter head forward of the shaft, certain advantages are obtained. First, by positioning the weight of the putter head forward of the shaft, when the putter is moved initially, less force must be applied to shaft by the user since the momentum of the front portion of the putter head weight pulls the shaft in the desired direction. In addition, this positioning of the putter head weight permits applying an overspin to the golf ball when it is struck so that is moves in the desired direction rather than an undesired up lifting of the ball causing it to become airborne.

The shaft extends directly into the head at a compound angle. A first angle of the shaft relative to a direction normal to the top surface of the head through the putter head is between about 10° and 20° preferably between about 11° and 14° toward the front face of the head. By angling the shaft in this manner, the tendency for the wrists to break down during the putting stroke is substantially reduced. The shaft also extends from the direction normal to the top surface of the head toward the user grasping the shaft at an angle between about 10° and 20°, preferably between 14° and 18°. The bottom-most surface of the shaft is positioned within or at the bottom surface the head. The shaft can be formed of any conventional material such as steel, graphite composition, aluminum, aluminum alloy or the like. It is preferred to utilize a low density material for the shaft such as aluminum or other low density alloy having about the same or lower density as aluminum.

The front face of the putter can be formed with a single angle of between about 0° and about 4°, preferably between about 1° and about 2°. In one embodiment of this invention, the front face of the putter can be formed with a compound angle have a first surface for striking the ball having an angle between about 0° and about 4°, preferably between about 1° and about 2° from the vertical direction and a second surface which intersects with the first surface having an angle between about 5° and about 12° from the vertical direction and which permits the user to better view the ball position on the front face.

The shaft has a center line extending the length of the shaft through the center of the shaft. On the center line, a mid-point is defined as being equidistant from the top surface of the head and the bottom surface of the shaft located within the head. It is desirable to locate that mid-point on the line normal to the top surface and perpendicular to the maximum width of the front face which passes through the center point on the front face which defines the center of the front face. This position of the midpoint can be varied a maximum distance of about 10% of the maximum width of the front face, preferably less than about 5% and, most preferably 0% of the maximum width in the direction of a line defining the maximum width of the front face.

In use, the end of the shaft distal from the head can be positioned between the user's arm closest to front face of the putter and the ribs of the user. Typically, the shaft length in this embodiment is between about 50 and about 60 inches. The hand of the user most remote from the front face is then positioned at an intermediate portion of the shaft and is used to initiate movement of the putter head. Alternatively, the shaft can have a conventional length with the shaft not contacting the user's upper body of between about 30 and 40 inches.

Figure 2:
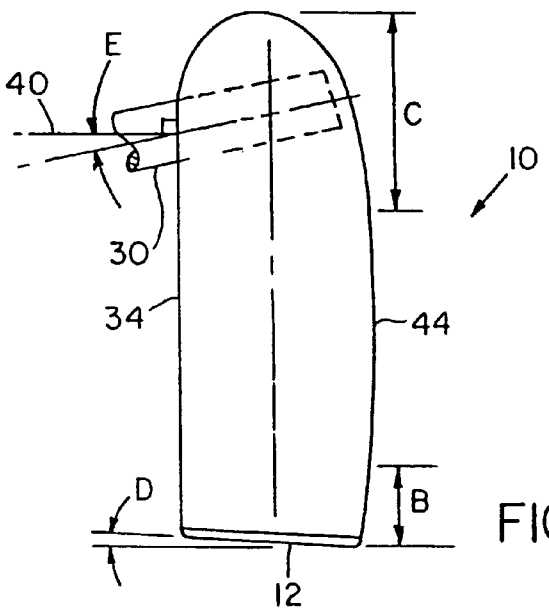
FIG. 2 is a side view of the putter of FIG. 1.
Figure 3:
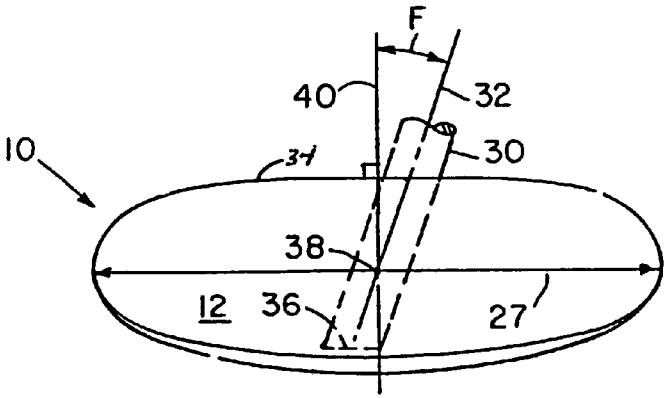
FIG. 3 is a front view of the putter of FIG. 1.

Referring to FIGS. 1, 2, and 3, the putter head of this invention 10 includes the front face 12, a back edge 14 which comprises the rearward edge of the head 10 extending between points 16 and 18. The front face can comprise a separate thin plate attached to the head 10 in any conventional manner or can comprise a surface of the head 10. The points 16 and 18 correspond to the most forward portion of the shaft 30 at the point of entry of the shaft 30 into the head 10. The portion of the outer surface of the head 10 extending from points 16 to front face 12 and from point 18 to front face 12 are referred to herein as the side edges in order to distinguish them from the back edge 14 and the front face 12. As best shown in FIG. 1, the outermost surface of the mallet, extending from the front face is almost entirely curved from the back edge toward the front face. The particular shape of the curve is not critical to the present invention and, for example, can be a portion of a circular curve, or a portion of an ellipse, parabolic or hyperbolic curve. In addition, a portion of the side edges can be linear, e.g. portion A of FIG. 1, if desired such that the portions of the curve on opposing surfaces can be linear and parallel. Alternatively, the outermost surface of the mallet comprising the back edge and side edges can be entirely curved. As best shown in FIG. 3, the front face has a major width comprising the longest distance 27 in the width direction.

The shaft 30 has a centerline 32 which extends through the center of the shaft 30 along its length. The portion of the centerline 32 positioned within the head 10 and extending from top surface 34 to the bottom surface 36 of the shaft 30 within the head 10 has a midpoint 38 which is equidistant between the top surface 34 and the bottom surface of the shaft 30. In the preferred embodiment of this invention, the midpoint 38 defines a plane 42 with a line 40 normal to the top surface 34 which extends through the center of face 12. The midpoint 38 should not deviate from the center point on the face 12 more than about 10%, preferably less than 5% of the distance and most preferably 0% of the distance of the maximum width of the front face in the direction of maximum width. For example, this distance can be measured from a line normal to the top surface 34 and passing through the centerpoint of front face 12, in the direction of maximum width. By so-positioning the center point 38, a larger sweet spot on front face 12 is obtained. As shown in FIG. 3, the shaft 30 enters the head 10 at a angle F from line 40 wherein line 40 is normal to the top surface 34, toward the user between about 10° and 20°, preferably between about 14° and 18°. As shown in FIG. 2, the shaft 30 extends at an angle E from the line 40, which is normal to the top surface 34, toward the front face 12 of between about 10° and 20°, preferably between about 11° and 14°. As shown in FIG. 2, the leading edge B of bottom surface 44 can be curved and the trailing edge C of the bottom surface 44 also can be curved. The front face 12 can have an angle D of between 0° and about 4°, preferably between about 1° and about 2°. According to the rules of the United States Golf Association, the width of a putter head must have a greater distance than the length of the putter head. Typical dimensions of the putter head of this invention are from 3 to 3½inches maximum width with a maximum length between the back edge and the front face being about ⅛ to 1/16inch shorter.

Figure 5:
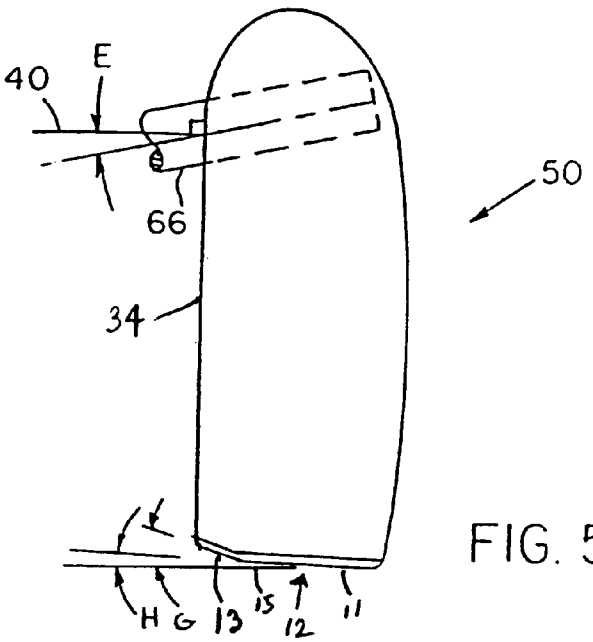
FIG. 5 is a side view of the putter of FIG. 4.
Figure 4:
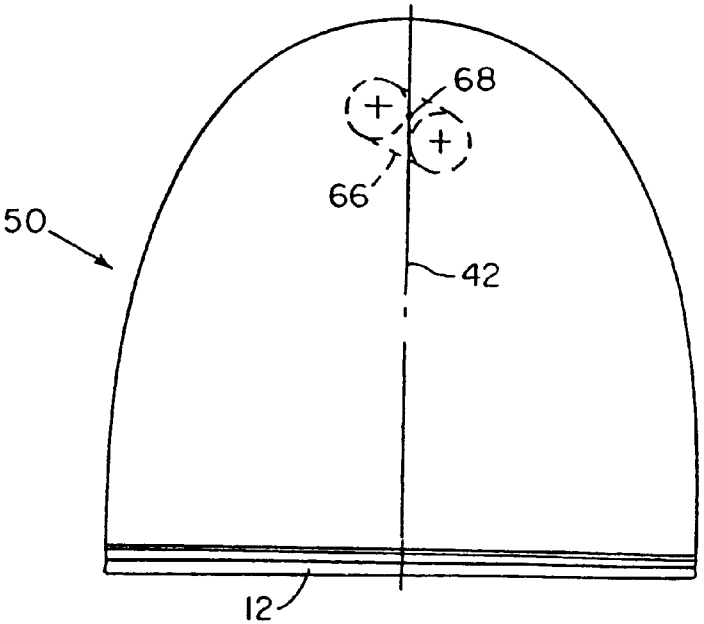
FIG. 4 is a top view of a putter of this invention having a putter head with a compound angle face.
Figure 6:
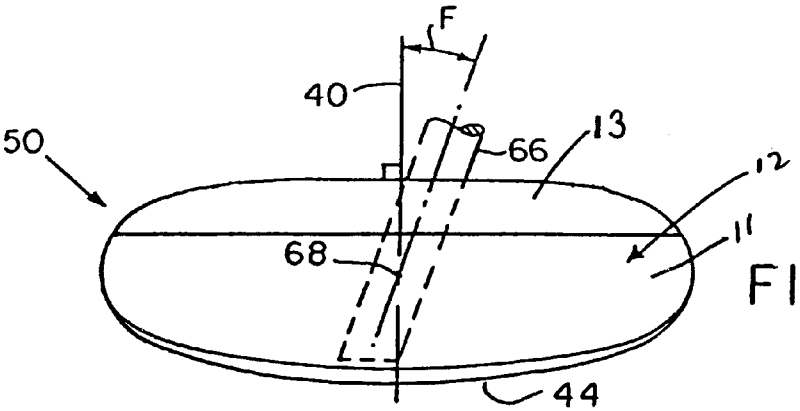
FIG. 6 is front view of the putter of FIG. 4.

Like reference numbers of FIGS. 4,5 and 6 as for FIGS. 1,2 and 3 refer to the same elements. Referring to FIGS. 4, 5 and 6, an embodiment of this invention is shown wherein the front face 12 is formed of a compound angle to form two flat surfaces. The bottom front face section 11 of front face 12 can have an angle H to the vertical direction 15, normal to the top surface 34, between 0° and about 4°, preferably between about 1° and about 2°. The top front face section of front face 12 has an angle, G, to the vertical direction 15 between about 5° and about 12°, preferably between about 8° and about 10°. The putter 50 also is providing with the shaft 66 having a midpoint 68 which are positioned in the same manner as described above with reference to midpoint 38 and shaft 30 with respect to FIGS. 1, 2 and 3.

Figure 8:
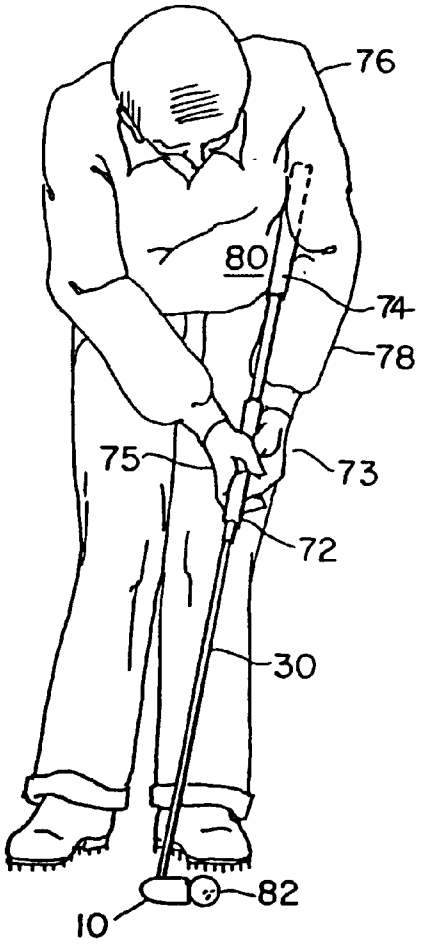
FIG. 8 illustrates the use of a putter of this invention.
Figure 7:
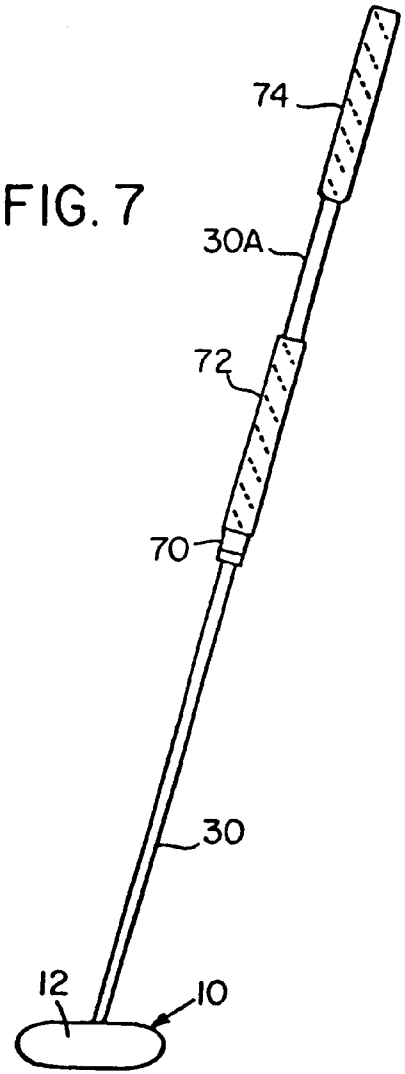
FIG. 7 is a front view of a putter of this invention.

Referring to FIGS. 7 and 8 an embodiment comprising the entire putter of this invention is shown which includes head 10 and a shaft 30. The shaft 30 can be formed from one or multiple pieces. When multiple pieces are utilized, a screw fitting 70 or the like is providing to attach upper portion 30A of the shaft to the shaft 30. Alternatively, the grips 72 and 74 can be formed of a single grip extending the substantially the entire length of upper shaft a portion 30A. The shaft 30 can be providing with a grips 72 and 74 which can be formed of rubber or the like. The grip 74 is positioned between the forward arm of the user and the user's ribs while the grip 72 is grasped by the user's hands or shoulders to effect movement of the putter. As shown in FIG. 8, the user 76 positions the putter of this invention with grips 74 positioned between the user's forward arm 78 and user's ribs 80. The grip 72 is grasped by the user's hands 73 and 75 in order to propel the head 10 against the golf ball 82.

Figure 9:
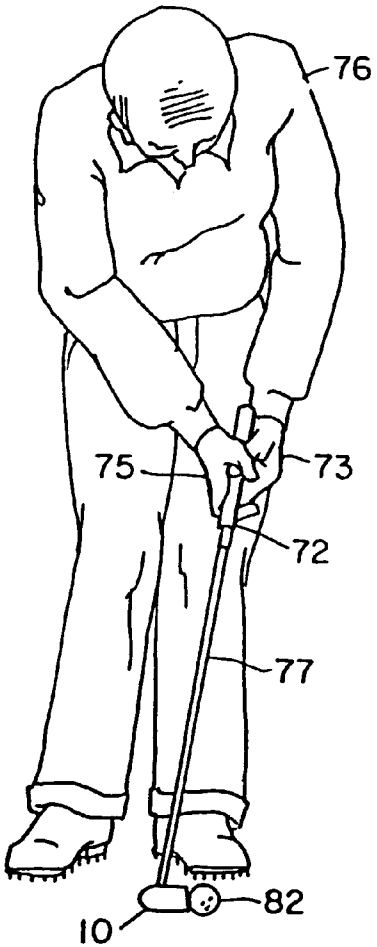
FIG. 9 is a front view illustrating the use of an alternative putter of this invention.

Referring to FIG. 9, the user 76 grasps a putter having a short shaft 77, provided with grip 72 to be gripped by the user's hands 73 and 75.

Figure 10:
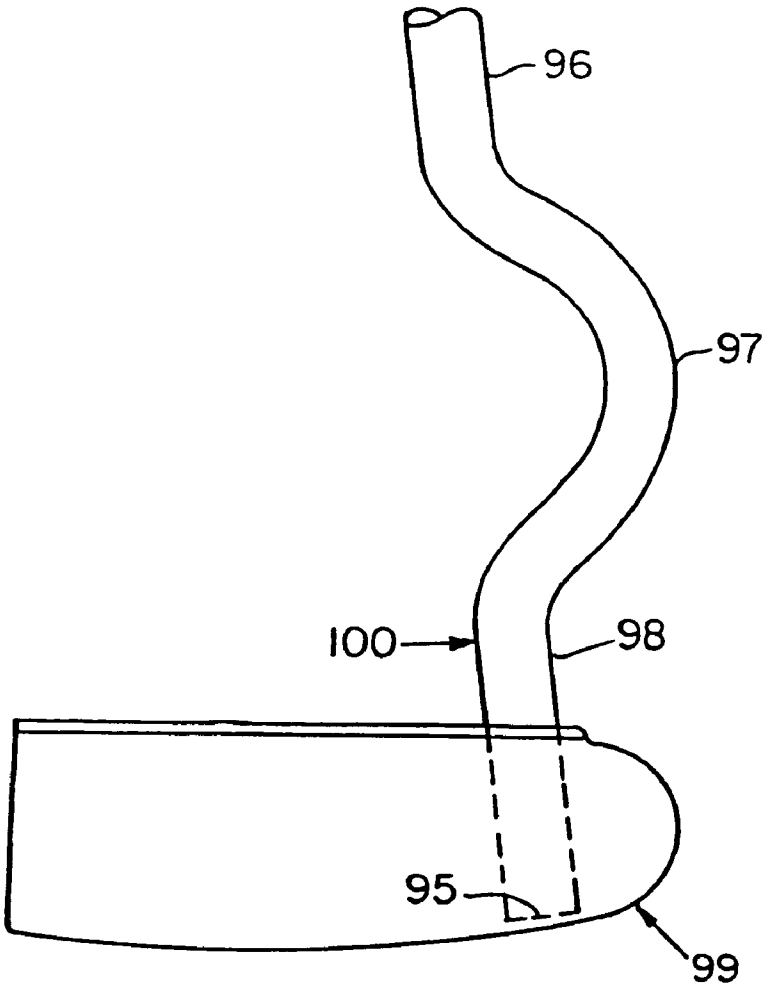
FIG. 10 is a side view of an alternative putter of this invention.

Referring to FIG. 10, an alternative shaft structure 100 is illustrated. The shaft 96 includes a bend 97 between straight shaft sections 96 and 98. Straight section 98 enters head 99 a depth which extends to bottom shaft surface 95. The shaft comprising shaft sections 96, 97 and 98 can be rotated 360° so that bend 97 can be oriented as desired by the user to position the top of the shaft (not shown) as desired the user's hands relative to the head 99. The angle of the shaft 100 relative to the user and relative to the front face are same as those described for the above embodiments.

Figure 11:
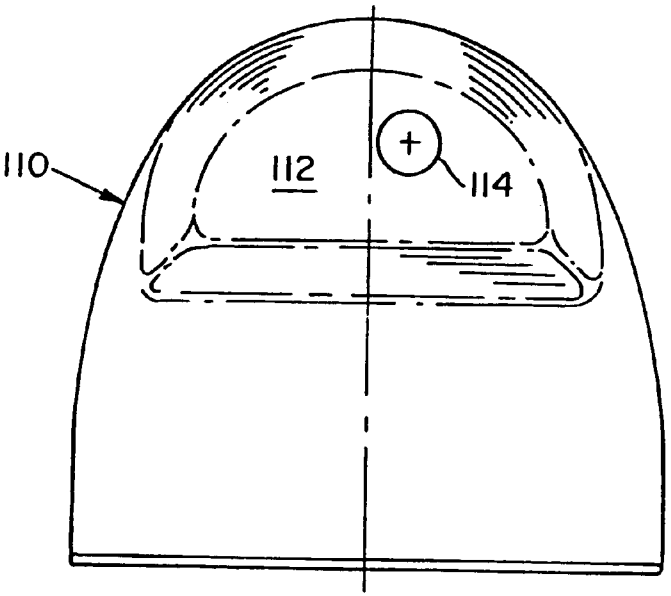
FIG. 11 is a top view of an alternative putter of this invention.
Figure 12:
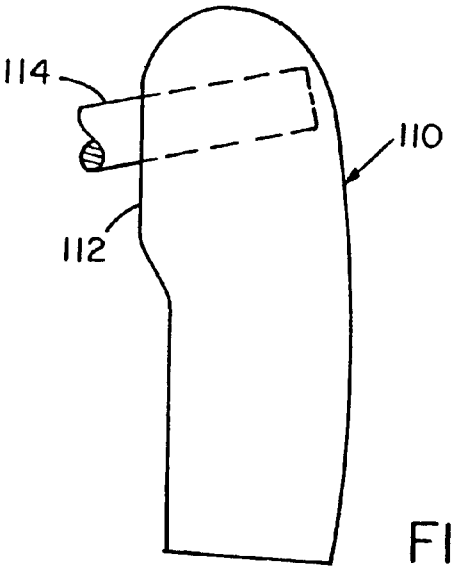
FIG. 12 is a side view of the putter of FIG. 11.
Figure 13:
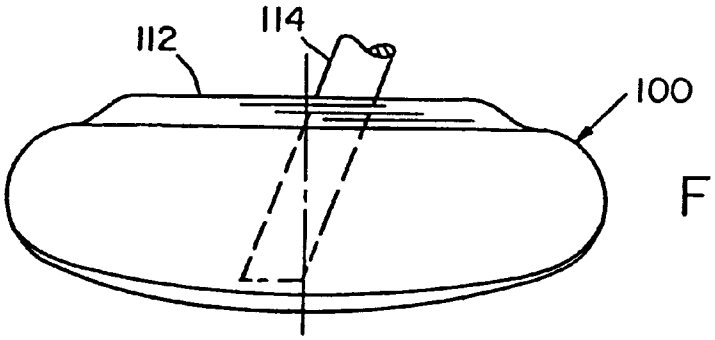
FIG. 13 is a front view of the putter of FIG. 11.

Referring to FIGS. 11, 12, and 13, head 110 can have a higher section 112 adjacent shaft 114 so that additional weight is positioned rearward on the head 110 adjacent the shaft 114.

Figure 15:
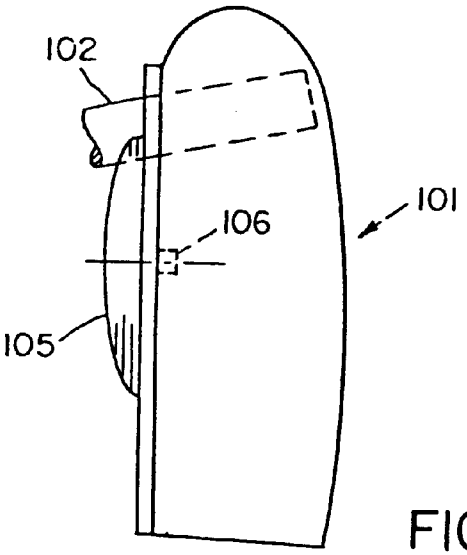
FIG. 15 is a side view of the putter of FIG. 14.
Figure 14:
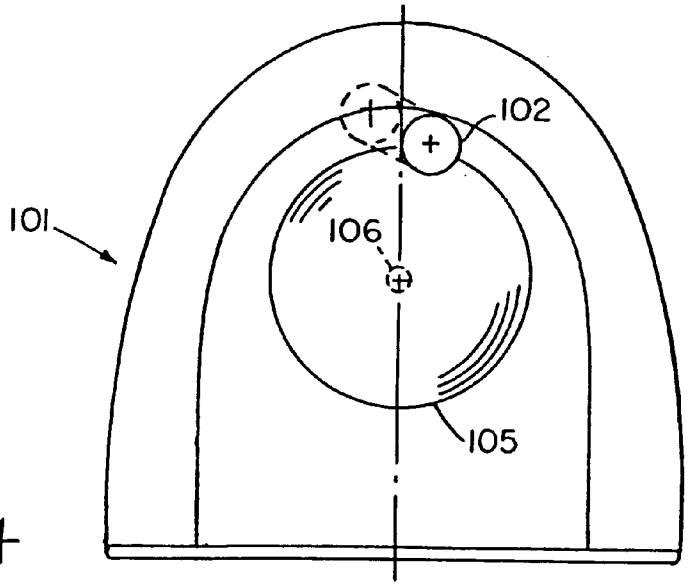
FIG. 14 is a top view of an alternative putter of this invention.
Figure 16:
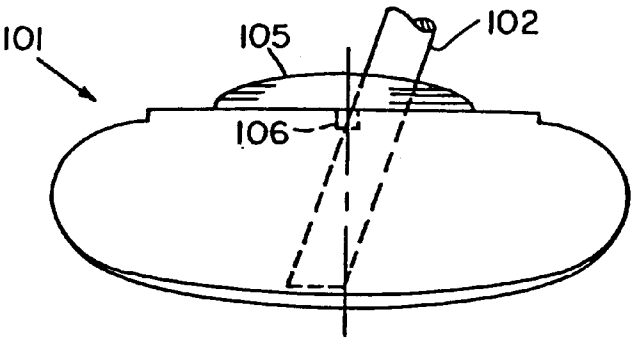
FIG. 16 is a front view of the putter of FIG. 14.

Referring to FIGS. 14, 15 and 16, the putter head 101 has shaft 102 attached to it. Weights 103 and 104 are positioned within the head 101. In addition, a weight 105 is positioned on the head 101 adjacent shaft 102 and is attached to the head 101 through a hole 106 provided in head 101. Any means for attaching the weight 105 to the head 101 can be employed such as a screw or by pouring molten lead or the like. The bottom front face section 91*a*, and top front face section 93 have the angles set forth above.

Figure 17:
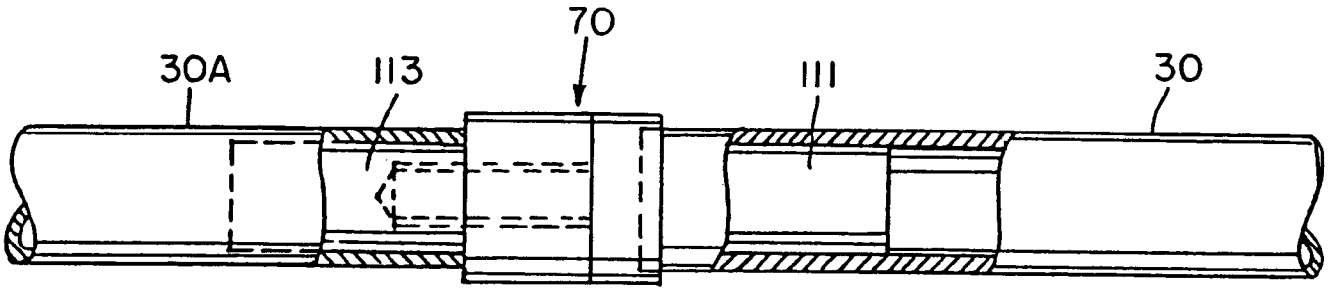
FIG. 17 illustrates a screw fitting for the shaft of the putter of this invention.
Figure 18:
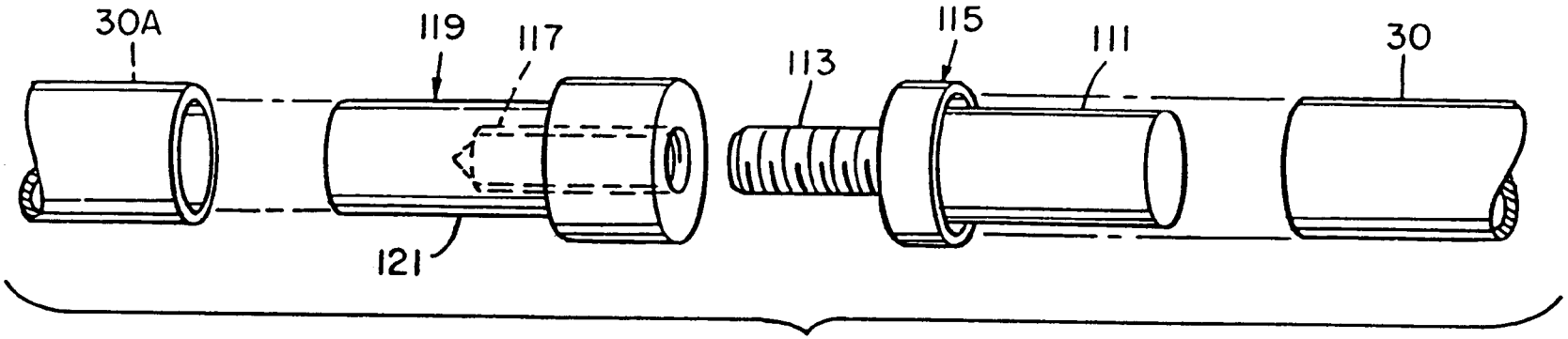
FIG. 18 is an exploded view of the screw fitting of FIG. 17.

Referring to FIGS. 17 and 18, the screw fitting 70 includes a male member 115 having an extension and a threaded extension. Extension 111 snugly fits into hollow shaft 30 and threaded extension 113 fits in threaded hole 117 of female member 119. Extension 121 fits snugly into hollow shaft extension 30A. The screw fitting 70 permits breaking down of the shaft 30 and upper shaft portion 30A by unscrewing the threaded extension 113 from the threaded hole 117 such as when traveling with the putter of this invention.

I claim:

1. A putter golf club comprising a shaft and a head, said head having a front face having a height and a maximum width, a back edge, a top surface and a bottom surface, said shaft extending into said head from said top surface at a first angle from a direction normal to said top surface toward said front face of between about 10° and about 20° and at a second angle from said direction normal to said top surface toward a user of said club between about 10° and about 20° and being positioned at least about 70% of a maximum length between said front surface and said back edge away from said front face, said shaft having a centerline extending the length of said shaft and a midpoint on said centerline positioned equidistant between said top surface of said head and a shaft bottom surface positioned within said head and said midpoint being positioned in a direction of a line defining a maximum width of said front face a distance less than about 10% of the maximum width of said front face from a line extending through a centerpoint of said front face and said line being normal to said top surface.

2. The club of claim 1 wherein the shaft has a length such that a shaft end can be positioned between an arm and ribs of a user of the putter.

3. The club of claim 1 wherein the shaft has a length between about 30 and about 40 inches.

4. The club of claim 1 wherein said head is formed from aluminum or low, density metal alloy.

5. The club of claim 1 wherein the shaft is positioned at least about 85% of the maximum length between said front face and said back edge away from said front face.

6. The club of claim 1 wherein said first angle is between about 11° and about 14°.

7. The club of claim 1 wherein the second angle is between about 14° and about 18°.

8. The club of claim 1 wherein said front face has a bottom section having an angle from a direction normal to said top surface and extending from said bottom surface toward said back edge between 0° and about 4° and a top section having an angle from a direction normal to said top surface and extending from said bottom section toward said back edge between about 5° and about 12°.

9. The club of claim 8 wherein the bottom section has an angle of between about 1° and 2°.

10. The club of any one of claims 1, 2, 3, 4, 5, 6, 7, 8, or 9 wherein said back edge is curved toward said front face.

11. A putter golf club comprising a shaft and a head, said head having a front face having a height and a maximum width, a back edge, a top surface and a bottom surface, said shaft extending into said head from said top surface at a first angle from a direction normal to said top surface toward said front face of between about 11° and about 14° and at a second angle from said direction normal to said top surface toward a user of said club between about 14° and about 18° and being positioned at least about 85% of a maximum length between said front surface and said back edge away from said front face, said shaft having a centerline extending the length of said shaft and a midpoint on said centerline positioned equidistant between said top surface of said head and a shaft bottom surface positioned within said head and said midpoint being positioned in a direction of a line defining a maximum width of a said front face a distance less than about 5% of the maximum width of said front face from a line extending through a center-point of said front face and said line being normal to said top surface.

12. The club of claim 11 wherein the head is formed from aluminum or a low density metal alloy.

13. The club of claim 11 wherein the shaft has a length such that a shaft end can be positioned between an arm and ribs of a user or under the arm pit.

14. The club of claim 11 wherein the shaft has a length between about 30 and about 40 inches.

15. The club of claim 11 wherein said front face has a bottom section having an angle from a direction normal to said top surface and extending from said bottom surface toward said back edge between 0° and about 4° and a top section having an angle from a direction normal to said top surface and extending from said bottom section toward said back edge between about 5° and about 12°.

16. The club of claim 15 wherein said front face has an angle between about 1° and 2° in a direction toward said back edge and from said bottom surface to said top surface.

17. The club of any one of claims 11, 12, 13, 14, 15 or 16 wherein said back edge is curved toward said front face.

18. The club of claim 1 wherein said shaft includes means for separating the shaft into two parts.

19. The club of claim 11 wherein said shaft includes means for separating the shaft into two parts.

20. The club of claim 10 wherein said shaft includes means for separating the shaft into two parts.

* * * * *